US010431415B2

(12) United States Patent
Lemaitre

(10) Patent No.: US 10,431,415 B2
(45) Date of Patent: Oct. 1, 2019

(54) X-RAY TUBE ION BARRIER

(71) Applicant: GENERAL ELECTRIC COMPANY, Schenectady, NY (US)

(72) Inventor: Sergio Lemaitre, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 127 days.

(21) Appl. No.: 15/820,899

(22) Filed: Nov. 22, 2017

(65) Prior Publication Data

US 2018/0144902 A1 May 24, 2018

Related U.S. Application Data

(60) Provisional application No. 62/425,892, filed on Nov. 23, 2016.

(51) Int. Cl.

| | |
|---|---|
| ***H01J 35/14*** | (2006.01) |
| ***H01J 35/08*** | (2006.01) |
| ***H01J 35/06*** | (2006.01) |
| ***H01J 35/04*** | (2006.01) |
| ***H01J 35/16*** | (2006.01) |

(52) U.S. Cl.

CPC ..... *H01J 35/14* (2013.01); *H01J 35/04* (2013.01); *H01J 35/06* (2013.01); *H01J 35/08* (2013.01); *H01J 35/16* (2013.01); *H01J 2235/168* (2013.01)

(58) Field of Classification Search

None

See application file for complete search history.

(56) References Cited

U.S. PATENT DOCUMENTS

| | | | | |
|---|---|---|---|---|
| 2003/0058995 | A1* | 3/2003 | Kutschera | H01J 35/10 378/144 |
| 2017/0250050 | A1* | 8/2017 | Lemaitre | H01J 35/06 |
| 2019/0131103 | A1* | 5/2019 | Tuohimaa | H01J 35/20 |

* cited by examiner

*Primary Examiner* — Hoon K Song

(57) ABSTRACT

In the present invention, a cathode is formed with one or more emitters energized to emit electrons that are accelerated towards an anode or target spaced from the cathode. Between the cathode and the target is disposed an ion barrier electrode defining an aperture therein disposed in alignment with the emitters to enable the electron beam to pass through the electrode. The barrier electrode is operably connected to a voltage supply to positively bias the barrier electrode, and the barrier electrode is shaped to minimize the required supply voltage. This positive voltage bias creates a positive potential barrier across the electrode sufficient to repel positive ions generated by the electron beam, protecting the cathode from contact with the ions and increasing the stability of the focal spot generated by the tube by maintaining the ions within the drift region between the ion barrier and the target.

20 Claims, 8 Drawing Sheets

X-RAY TUBE ION BARRIER

BACKGROUND

The subject matter disclosed herein relates to X-ray tubes, and in particular to emitters for use in X-ray tubes.

Presently available medical X-ray tubes typically include a cathode assembly having an emitter and a cup. The cathode assembly is oriented to face an X-ray tube anode, or target, which is typically a planar metal or composite structure. The space within the X-ray tube between the cathode and anode is evacuated.

X-ray tubes typically include an electron source, such as a cathode, that releases electrons at high acceleration. Some of the released electrons may impact a target anode. The collision of the electrons with the target anode produces X-rays, which may be used in a variety of medical devices such as computed tomography (CT) imaging systems, X-ray scanners, and so forth.

To improve the useful life of the emitters used to generate the electron beams and thus the useful life of the X-ray tubes, a flat surface emitter (or a 'flat emitter') may be positioned within the cathode cup with the flat surface positioned orthogonal to the anode, such as that disclosed in U.S. Pat. No. 8,831,178, incorporated herein by reference in its entirety. In the '178 patent a flat emitter with a rectangular emission area is formed with a very thin material having electrodes attached thereto.

X-ray tubes having cathodes with flat emitters can control the flow of electrons from the emitter to the target using a grid electrode. The electron emission originating from the surface of a thermoionic electron emitter, the flat emitter, strongly depends on the "pulling" electric field generated by the X-ray tube's anode. For enabling fast on/off switching of the tube, it is known from the relevant prior art that X-ray tubes of the rotary-anode type may be equipped with a grid electrode placed in front of the electron emitter. To shut off the electron beam completely, a bias voltage is applied to the grid electrode which generates a repelling field and is usually given by the absolute value of the potential difference between the electron emitter and the grid electrode. The resulting electric field at the emitter surface is the sum of the grid and the anode generated field. If the total field is repelling on all locations on the electron emitter, electron emission is completely cut off.

Additionally, in X-ray tubes employing a flat filament/emitter and focal spot control via electrostatic focusing, such as disclosed in co-owned U.S. Pat. No. 8,401,151, entitled "X-Ray Tube For Microsecond X-Ray Intensity Switching" the entirety of which is expressly incorporated by reference herein for all purposes, the electron beam drifts a distance of several centimeters past the anode in electric field free region before reaching the target. Due to the increased travel distance more residual gas ions are produced.

However, in all X-ray tubes an amount of residual gas is present within the tube as a result of the manufacturing processes for the tubes. When electrons generated by the emitters and drawn towards the anode strike the residual gas, the gas becomes ionized. As this ion charge is opposite that of the electrons generated by the emitter and ions are much heavier than electrons, the ions are drawn to the center 300 of the emitter 1000 where these ions strike the emitter 1000 causing damage to the emitter surface through sputtering and/or local overheating as shown in FIG. 3. Over time, this damage accumulates and can completely break or sever the ribbon of material forming the emitter 1000, thereby severing the circuit for current flow through the emitter and rendering the X-ray tube inoperative. Due to the residual gas ionization caused by collisions of primary beam electrons as well as the backscattered electrons with the gas particles and other contaminants in the tube volume, the positively charged ions accelerated towards the cathode have a detrimental impact on cathode performance and/or function as well as on electron beam stability which can result in focal spot performance degradation.

Further, these problems have been exacerbated with the constructions of recently developed high power tubes that include an additional electron drift path to allow advanced electron beam manipulation with magnets. Due to the increased beam path in these tubes, more ions are generated along the electron beam path and consequently the impact of the positive ions striking the cathode create even more severe problems relating to the functioning of the cathode and/or focal spot instability.

More particularly, with regard to the impact of the ions striking the cathode or emitters, ions impacting the emitter lead to local overheating and to sputtering of the emitter. Both effects can lead to emitter failure (damage, burnout), resulting in premature replacement of the tube being necessary. In addition, ions impacting electrically biased cathode structures, such as an extraction electrode present in newer x-ray tube designs, present an additional "load" to the bias supply for those structures. Such a load can require either sinking our sourcing current from the supply depending on the bias polarity ([+]=sinking, [−]=sourcing). As the intensity of ion current is dependent on tube environment (temperature, pressure), the contact of the ions with the cathode/emitters puts an additional burden on power supply requirements and may degrade control of the electron beam emerging from the cathode.

Also, due to the interactions of the ions with the electron beam emitted from the cathode, the ions can detrimentally affect the stability of the electron beam, even in the presence of magnetic focusing elements (e.g. quadrupoles). As such, the stability of the focal spot formed by the electron beam can be negatively impacted by the movement of the ions through the electron beam towards the cathode, which can be observed as sudden changes in focal spot size.

To limit the ion bombardment of prior art emitters, various types of ion barriers are utilized. These ion barriers are disposed downstream from the emitter and operate to draw the ions in or onto the barriers or inhibit ions to travel past the barriers.

In one prior art construction, disclosed in US Patent Application Publication No. US2010/0177874, an ion barrier is constructed with an ion-deflecting and an ion collecting set up. In this set up a pair of electrodes is disposed on opposed sides of an electron beam. The electrodes are oppositely charged, with the positively charged electrode functioning as an ion deflector and the negatively charged electrode acting as an ion collector.

However, while somewhat effective in preventing ions from bombarding the emitters, this type of ion barrier creates significant additional complexity and expense in the construction of the X-ray tube. Further, the use of both ion deflectors and ion collectors can enable ions to move between the oppositely biased electrodes as a result of the pulling and repelling forces exerted by the separate electrodes.

Another prior art design of an ion barrier is disclosed in US Patent Application Publication No. US2015/0179388. In this structure, a plate-like conductive member is disposed within a conductive housing adjacent a cathode that is mounted to the conductive housing that is supplied with an electric potential. The conductive member is provided with a positive or negative bias in order to function as an ion repelling barrier or as an ion collector, depending upon the desired function for the conductive member and the conductive potential applied to the housing, as the housing forms a separate conductive element that interacts electrically with the conductive member to form the ion barrier.

However, being formed with a plate-like structure, the conductive member utilized in this prior art ion barrier requires a significant voltage in order to effectively function to repel or attract the ions moving towards the conductive member. Particularly, in this prior art in repelling mode the ion barrier plate is envisioned to be located downstream from the cathode to form the accelerating field for the electrons, thus being exposed to potentially damaging transient events with the high cathode potential. Further, the placement of the conductive member within but spaced from the interior surface of the housing significantly increases the cost and complexity of the construction of the device and provides a space between the barrier and the housing through which ions can pass. Especially, in high power x-ray tubes that are not considered in this prior art, the cross section of the electron beam is increased thus requiring an increased size of the ion barrier aperture and consequently requiring larger barrier voltages.

Hence it is desirable to provide an X-ray tube with an ion barrier which can effectively and efficiently function to limit the damage caused to the emitter as a result of ion bombardment, thereby increasing the useful life of the emitter and the X-ray tube without significantly increasing the complexity or cost of the construction of the X-ray tube.

BRIEF DESCRIPTION

There is a need or desire for an ion barrier that is capable of minimizing the damage done to the emitter as a result of being struck by charged gas ions formed within to increase the useful life of the X-ray tube including the emitter. The above-mentioned drawbacks and needs are addressed by the embodiments described herein in the following description.

In the present invention, a cathode is formed with one or more emitters, such as flat emitters, disposed within a cathode cup of the X-ray tube. The cathode is energized to emit electrons that move away from the cathode and are accelerated towards an anode or target spaced from the cathode. Adjacent the cathode and between the cathode and the target, the tube includes an ion barrier electrode. The ion barrier electrode is formed as a ring-like structure defining an aperture therein that is disposed in alignment with the emitters to enable the electron beam produced by the emitters to pass through the ion barrier electrode.

The ion barrier electrode is operably connected to a current supply that provides a positive voltage bias to the ion barrier electrode. This positive voltage bias creates a positive potential within the tube across the ion barrier electrode or about a region including the ion barrier electrode or about a region including the ion barrier electrode and space extending beyond the perimetric boundaries of the ion barrier electrode that is sufficient to repel all positive ions generated by the electron beam downstream from the ion barrier electrode, thus protecting the cathode/emitters from degrading due to contact by positively charged ions and increasing the stability of the focal spot generated by the tube by maintaining the ions within the drift region between the ion barrier and the anode. The minimum positive bias required to form the positive potential barrier across the barrier electrode is dependent primarily on the geometry of the electrode and the tube voltage. As such, the ion barrier electrode can be constructed to have a sufficient size for the particular tube voltage and can be operated in a manner that corresponds to the operational tube voltage to maintain at least the minimum positive potential barrier, thereby increasing the useful life of the tube. Furthermore, the aperture of the ion barrier having a shape normal to the electron beam and a length in the direction of the electron beam as to minimize the necessary voltage to establish the positive barrier potential.

One exemplary embodiment of the invention is an X-ray tube including an electrically insulating housing, a cathode disposed within the housing and configured to emit a beam of electrons, and an anode defining a central aperture. The anode is disposed within the housing and spaced from the cathode to define an acceleration area to accelerate the beam of electrons through the opening in the anode. A target is spaced from the anode within the housing and adapted to emit x-rays when struck by the beam of electrons. The tube further includes an ion barrier electrode disposed within the housing between the cathode and the target, the ion barrier electrode defining an aperture through which the beams of electrons can pass, and a voltage source connected to the ion barrier electrode to apply a voltage bias thereto and generate a positively charged potential barrier across the ion barrier electrode to deflect positively charged ions contacting the potential barrier.

Another exemplary embodiment of the invention is a method for minimizing damage to an emitter in an X-ray tube as a result of bombardment by positively charged ions within the X-ray tube to extend the useful life of the X-ray tube including the steps of providing an X-ray tube including an electrically insulating housing, a cathode disposed within the housing and configured to emit a beam of electrons, an anode disposed within the housing and spaced from the cathode, the anode including an opening through which the electron beam can pass, a target spaced from the anode within the housing and adapted to emit x-rays when struck by the beam of electrons, an ion barrier electrode disposed within the housing between the cathode and the target and defining an aperture through which the beams of electrons can pass and a voltage source connected to the ion barrier electrode to generate a positively charged potential barrier across the ion barrier electrode to repel positively charged ions contacting the potential barrier. The method may further include passing a current through the emitter to generate an electron beam that passes through the ion barrier electrode and generating an exclusively positive potential barrier in the region of the ion barrier electrode that repels positively charged ions formed by the electron beam from passing through the ion barrier electrode.

Another exemplary embodiment of the invention is a method for stabilizing a focal spot for an electron beam in an X-ray tube including the steps of providing an X-ray tube including an electrically insulating housing, a cathode disposed within the housing and configured to emit a beam of electrons, an anode with an aperture to pass the electron beam, a target spaced from the anode within the housing and adapted to emit x-rays when struck by the beam of electrons, an ion barrier electrode disposed within the housing between the anode and the target and defining an aperture through which the beams of electrons can pass and a voltage source connected to the ion barrier electrode to generate a positively charged potential barrier across the ion barrier electrode to repel positively charged ions contacting the potential barrier. This method may further include passing a current through the emitter to generate an electron beam that passes through the ion barrier electrode and generating a positive potential barrier on the ion barrier electrode that maintains positively charged ions in the drift region which create a charge balance with the negative electron beam.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure

BRIEF DESCRIPTION OF THE DRAWINGS

The drawings illustrate the best mode presently contemplated of carrying out the disclosure. In the drawings.

DETAILED DESCRIPTION

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Exemplary embodiments of the invention relate to an X-ray tube including an cathode assembly with a robust flat emitter. The emitter is formed of a ribbon of a material that emits electrons when heated in order to produce X-rays when the beam of electrons strikes a target. The emitter additionally includes a void disposed in the material forming the ribbon in order to form a space within the emitter through which positively charged gas ions can pass without striking and damaging the ribbon material.

Figure 1:
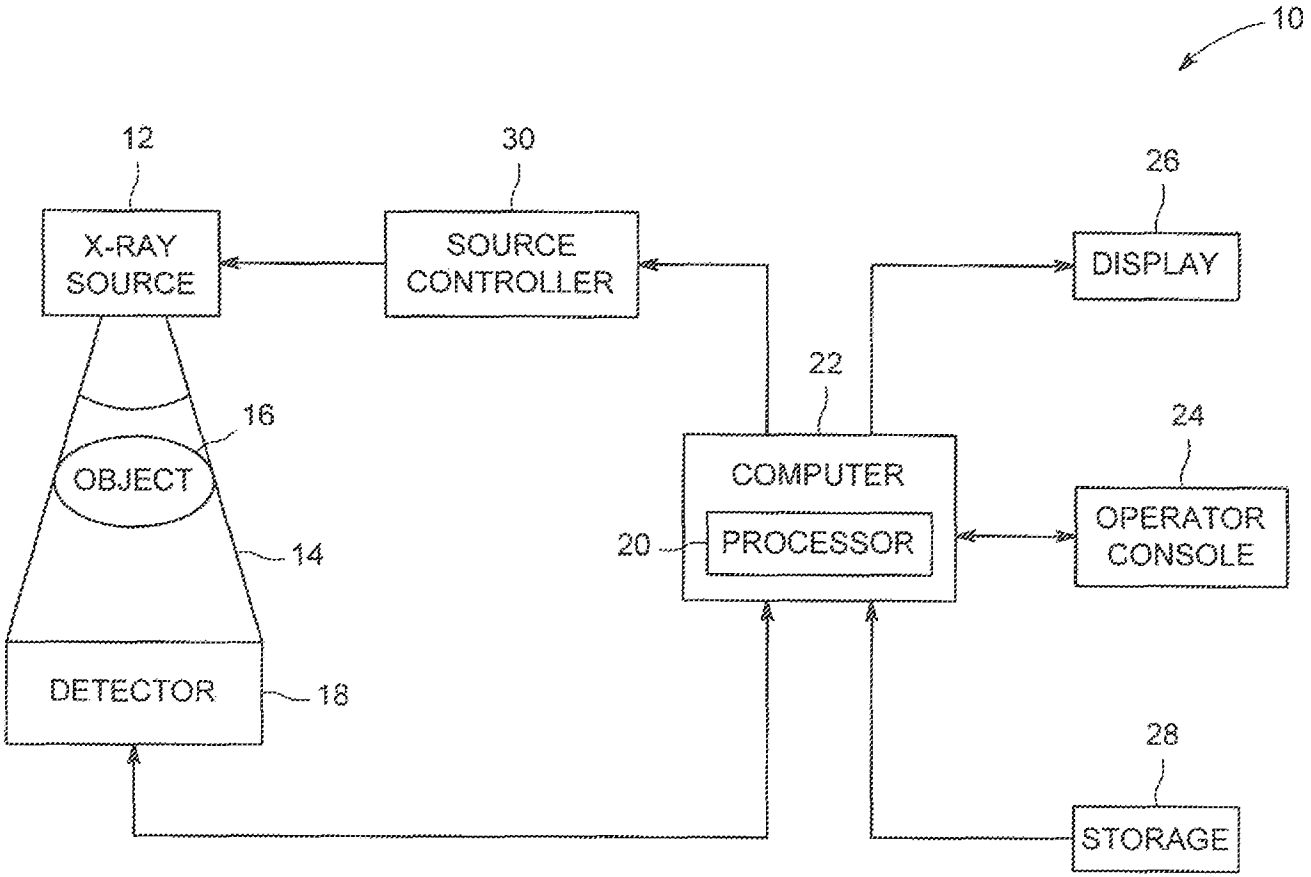
FIG. 1 is a block diagram of an imaging system according to an exemplary embodiment of the invention.

FIG. 1 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
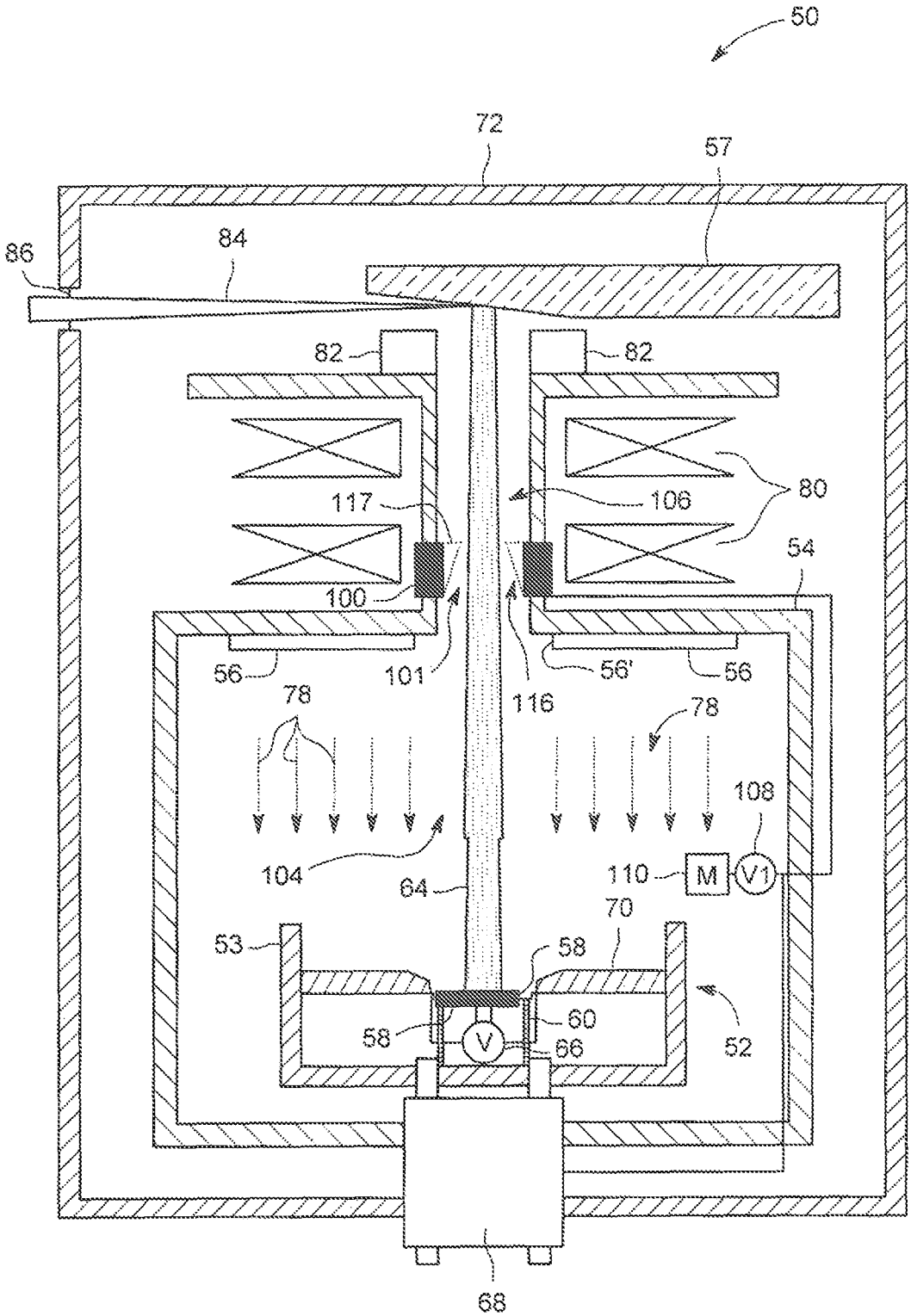
FIG. 2 is a cross-sectional view of an x-ray tube/source according to an exemplary embodiment of the invention.

FIG. 2 is a diagrammatical illustration of an exemplary X-ray tube 50, in accordance with aspects of the present technique. In one embodiment, the X-ray tube 50 may be the X-ray source 12 (see FIG. 1). In the illustrated embodiment, the X-ray tube 50 includes an exemplary injector or cathode assembly 52 and an anode 56 defining an opening 56'. Anode 56 is disposed within or as a portion of a vacuum wall 54 in the exemplary embodiment of an anode-grounded tube 50. Further, the injector 52 includes an injector wall 53 that encloses various components of the injector 52. In addition, the X-ray tube 50 also includes an X-ray target 57. The injector 52 and the anode 56 are disposed within the interior of a tube casing 72 and the interior of tube casing 72 is desirably evacuated. In accordance with aspects of the present technique, the injector 52 may include at least one cathode in the form of at least one emitter 58. In the present example, the cathode, and in particular the emitter 58, may be directly heated. Further, the emitter 58 may be coupled to an emitter support/cathode cup 60, and the emitter support/cathode cup 60 in turn may be coupled to the injector wall 53. The emitter 58 may be heated by passing a large current through the emitter 58. A voltage source 66 may supply this current to the emitter 58. In one embodiment, a current of about 10 amps (A) may be passed through the emitter 58. The emitter 58 may emit an electron beam 64 as a result of being heated by the current supplied by the voltage source 66. As used herein, the term "electron beam" may be used to refer to a stream of electrons that have substantially similar velocities.

The electron beam 64 may be directed towards the target 57 to produce X-rays 84 that exit the tube 50 through a window 86. More particularly, the electron beam 64 may be accelerated from the emitter 58 through the anode 56 towards the target 57 by applying a potential difference between the emitter 58 and the anode 56. In one embodiment, a high voltage in a range from about 40 kV to about 450 kV may be applied via use of a high voltage feedthrough 68 to set up a potential difference between the emitter 58 and the anode 56, thereby generating a high voltage main electric field 78. In one embodiment, a high voltage differential of about 140 kV may be applied between the emitter 58 and the anode 56 to accelerate the electrons in the electron beam 64 towards the target 57. It may be noted that in the presently contemplated configuration, the anode 56 may be at ground potential. By way of example, the emitter 58 may be at a potential of about −140 kV and the anode 56 may be at ground potential or about zero volts.

Moreover, when the electron beam 64 impinges upon the target 57, a large amount of heat is generated in the target 57. As the heat generated in the target 57 may be significant enough to melt the target 57, target 57 is desirably rotated so as to circumvent the problem of heat generation in the target 57. More particularly, in one embodiment, the target 57 may be configured to rotate such that the electron beam 64 strikes the target 57 at a location which is rotated away and thus allowed to cool before coming back under the electron beam 64 again. In another embodiment, the target 57 may include a stationary target. Furthermore, the target 57 may be made of a material that is capable of withstanding the heat generated by the impact of the electron beam 64. For example, the target 57 may include materials such as, but not limited to, tungsten, molybdenum, or copper.

With continuing reference to FIG. 2, the injector/cathode assembly 52 may include at least one focusing electrode 70. In one embodiment, the at least one focusing electrode 70 may be disposed adjacent to the emitter 58 such that the focusing electrode 70 focuses the electron beam 64 towards the target 57. As used herein, the term "adjacent" means near to in space or position. Further, in one embodiment, the focusing electrode 70 may be maintained at a voltage potential that is less than a voltage potential of the emitter 58. The potential difference between the emitter 58 and focusing electrode 70 prevents electrons generated from the emitter 58 from moving towards the focusing electrode 70. In one embodiment, the focusing electrode 70 may be maintained at a negative potential with respect to that of the emitter 58. The negative potential of the focusing electrode 70 with respect to the emitter 58 focuses the electron beam 64 away from the focusing electrode 70 and thereby facilitates focusing of the electron beam 64 towards the target 57.

In another embodiment, the focusing electrode 70 may be maintained at a voltage potential that is equal to or substantially similar to the voltage potential of the emitter 58. The similar voltage potential of the focusing electrode 70 with respect to the voltage potential of the emitter 58 creates a parallel electron beam by shaping electrostatic fields due to the shape of the focusing electrode 70. The focusing electrode 70 may be maintained at a voltage potential that is equal to or substantially similar to the voltage potential of the emitter 58 via use of a lead (not shown in FIG. 2) that couples the emitter 58 and the focusing electrode 70.

Figure 3:
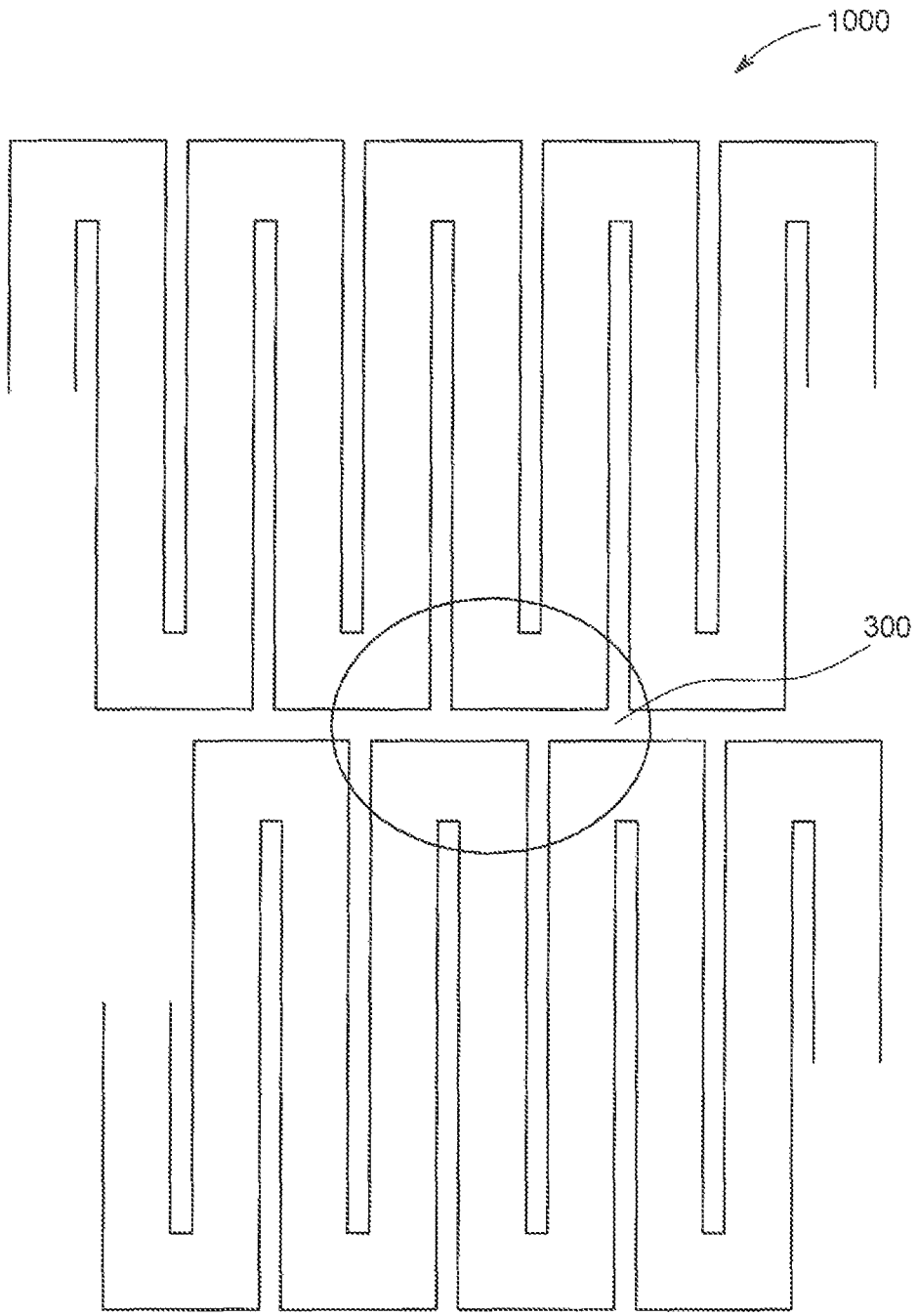
PRIOR ART FIG. 3
FIG. 3 is a top plan view of a prior art emitter construction.

Additionally, the exemplary X-ray tube 50 may also include a magnetic assembly 80 for focusing and/or positioning and deflecting the electron beam 64 on the target 57. In one embodiment, the magnetic assembly 80 may be disposed between the injector 52 and the target 57, and in one exemplary embodiment at a distance of between 20-40 mm from the anode or extraction electrode 74. In one embodiment, the magnetic assembly 80 may include one or more multipole magnets for influencing focusing of the electron beam 64 by creating a magnetic field that shapes the electron beam 64 on the X-ray target 57. The one or more multipole magnets may include one or more quadrupole magnets, one or more dipole magnets, or combinations thereof. As the properties of the electron beam current and voltage change rapidly, the effect of space charge and electrostatic focusing in the injector will change accordingly. In order to maintain a stable focal spot size, or quickly modify focal spot size according to system requirements, the magnetic assembly 80 provides a magnetic field having a performance controllable from steady-state to a sub-30 microsecond time scale for a wide range of focal spot sizes. This provides protection of the X-ray source system, as well as achieving CT system performance requirements. Additionally, the magnetic assembly 80 may include one or more dipole magnets for deflection and positioning of the electron beam 64 at a desired location on the X-ray target 57. The electron beam 64 that has been focused and positioned impinges upon the target 57 to generate the X-rays 84. The X-rays 84 generated by collision of the electron beam 64 with the target 57 may be directed from the X-ray tube 50 through an opening in the tube casing 72, which may be generally referred to as an X-ray window 86, towards an object (not shown in FIG. 3).

With continuing reference to FIG. 2, the electrons in the electron beam 64 may get backscattered after striking the target 57. Therefore, the exemplary X-ray tube 50 may include an electron collector 82. In accordance with aspects of the present technique, the electron collector 82 may be maintained at a ground potential. In an alternative embodiment, the electron collector 82 may be maintained at a potential that is substantially similar to the potential of the target 57. Further, in one embodiment, the electron collector 82 may be located adjacent to the target 57 to collect the electrons backscattered from the target 57. In addition, the electron collector 82 may be formed from a refractory material, such as, but not limited to, molybdenum. Furthermore, in one embodiment, the electron collector 82 may be formed from copper. In another embodiment, the electron collector 82 may be formed from a combination of a refractory metal and copper.

Figure 4:
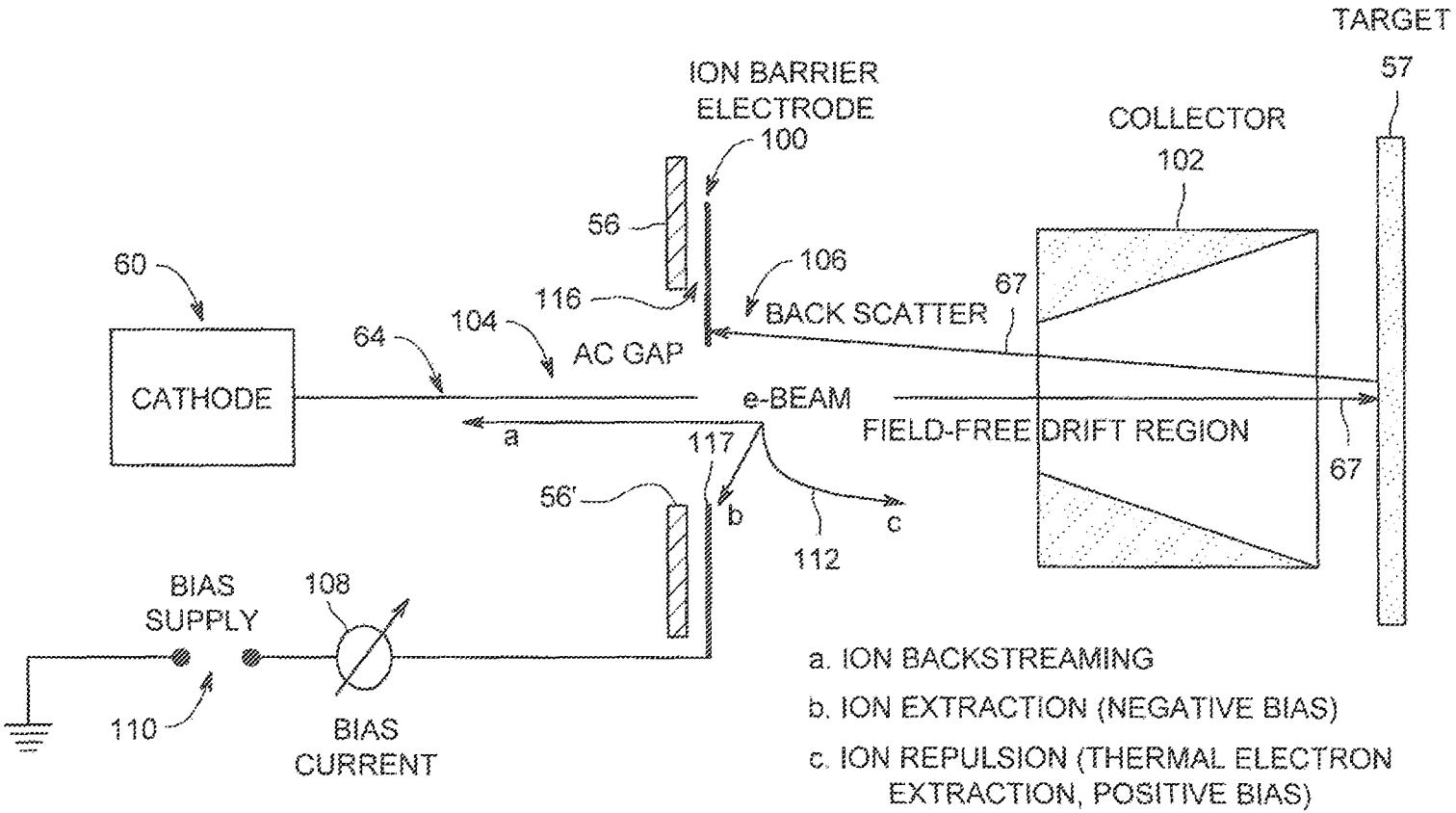
FIG. 4 is a schematic view of an x-ray tube construction according to an exemplary embodiment of the invention.
Figure 5:
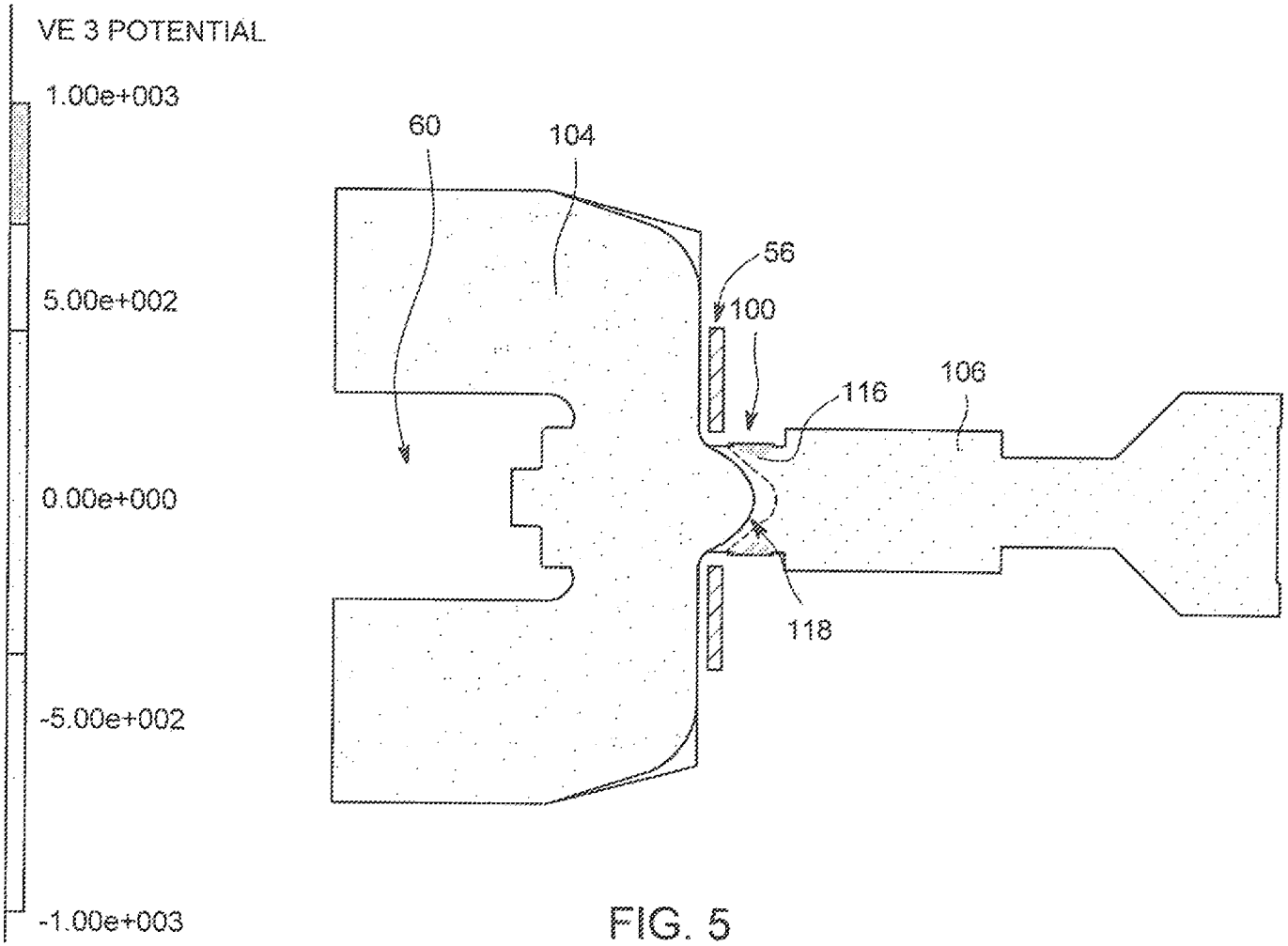
FIG. 5 is a cross-sectional view of an x-ray tube and potential distribution formed within the tube view according to another exemplary embodiment of the invention.

Referring now to FIGS. 2 and 4-5, an ion barrier electrode 100 is disposed within the electrically insulating housing 50 and is spaced between the cathode assembly 60 and the anode or target 57. In the illustrated exemplary embodiment, the x-ray tube 12 can also include additional structures along the path of the electrons 67 forming the electron beam 64, including various focusing electrodes 70, extraction electrodes (not shown), electron collectors 82 and ion collectors 102, among others. The ion barrier electrode 100 can be located where necessary in the tube 12, and in the illustrated exemplary embodiment is disposed downstream of the cathode assembly 60 beyond the acceleration area or gap 104 formed between the cathode assembly 60 and the anode 56 in the free drift region 106 of the tube 12. The ion barrier electrode 100 placed in the drift space or region 106 close to the anode 56 in to maximize the volume between the barrier electrode 100 and the target 57 where ions are created. The electrode 100 is operably connected to a bias current 108 from a power supply 110 that is connected to the electrode 100 through the electrically insulating housing 50 in order to provide the desired positive bias to the electrode 100.

Figure 6:
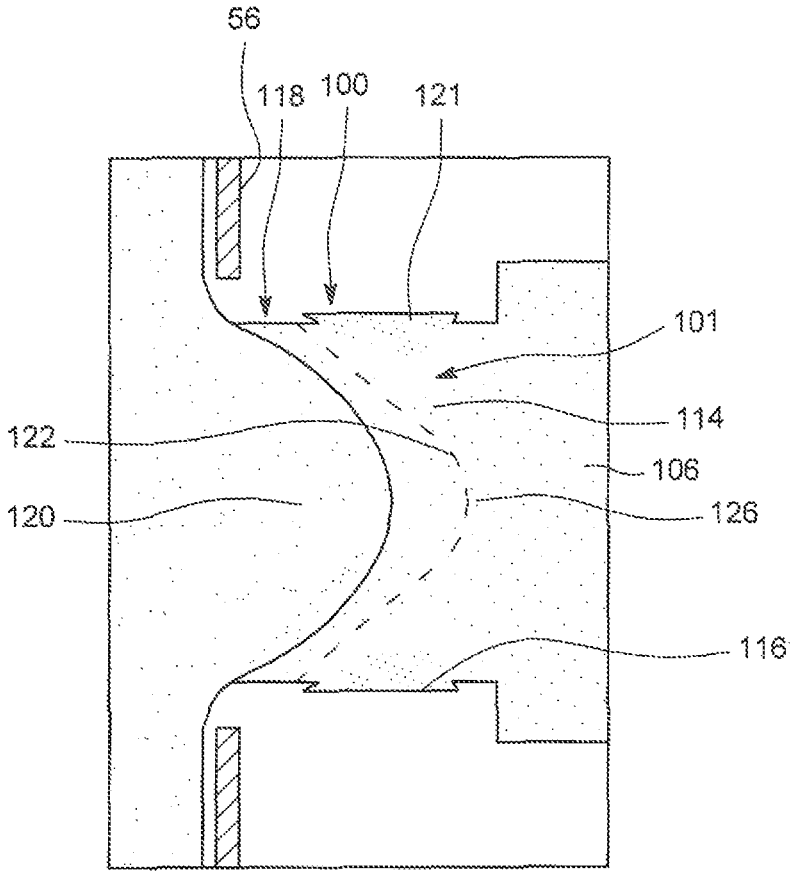
FIG. 6 is a partially broken away schematic view of the potential distribution curve formed within the x-ray tube of FIG. 5 according to still another exemplary embodiment of the invention.

The location of the electrode 100 enables the positive bias of the electrode 100 repel ions 112 created by the contact of the electrons 67 within the electron beam 64 with gas particles (not shown) residing within housing 50 after evacuation. Referring to FIG. 5, as the positive bias to the ion barrier electrode 100 is increased, the electrical potential in the volume 114 where the electron beam travels and that is surrounded by the electrode 100 becomes more positive. This effect is strongest in close proximity to the walls of the barrier electrode 100 and is least pronounced in the middle of the electrode aperture 116, which is disposed in alignment with the opening 56' in anode 56, and which typically coincides with the location of the electron beam 64. Therefore, a barrier electrode 100 having a smaller diameter and longer in the direction of the electron beam will require less positive bias to repel ions effectively and vice versa. In FIGS. 5 and 6 an exemplary potential distribution 118 for an active ion barrier electrode 100 is illustrated. As illustrated, a strong negative potential 120 is located in the acceleration area 104 between the cathode assembly 60 and the anode 56 that is highly attractive to ions generated in the drift region 106 downstream of the ion barrier electrode 100 which is at positive potential.

When supplied with a positive voltage via the bias supply 110, the ion barrier electrode 100 creates a strong positive potential 121 in proximity to the perimeter of the electrode 100. The strength of this positive potential 121 weakens towards the center of the aperture 116 of the electrode 100 but a small region or band of positive potential 122 is maintained across the center of the volume 114 within the aperture 116 defining the interior of the electrode 100 where the potential is always positive. This positive potential barrier wall 126 is dome-shaped and extends across the entire diameter of the interior 101 of the electrode 100 to repel any positively charged ions 112 contacting the barrier 126. One can also appreciate that the electron beam 64 itself introduces a negative space charge potential into the acceleration area 104 and drift region 106. This negative charge has to be overcome by the barrier potential 126 as well. As a result, because higher intensity electrons 67 within the beam 64 introduce more negative charge into the area 104 and region 106, the ion barrier electrode 100 must be operated at a bias voltage to provide a higher barrier potential 126. The actual value of the bias voltage necessary to achieve the desired barrier potential 126 also depends on quality of the power supply 110. This is because a sufficiently large voltage ripple in the power supply 110 could cause a momentary reduction in the barrier potential 126, resulting in the lowering of the potential of the barrier 126 to a point where ions 112 can pass through the ion barrier electrode 100 towards the cathode assembly 60.

Figure 7:
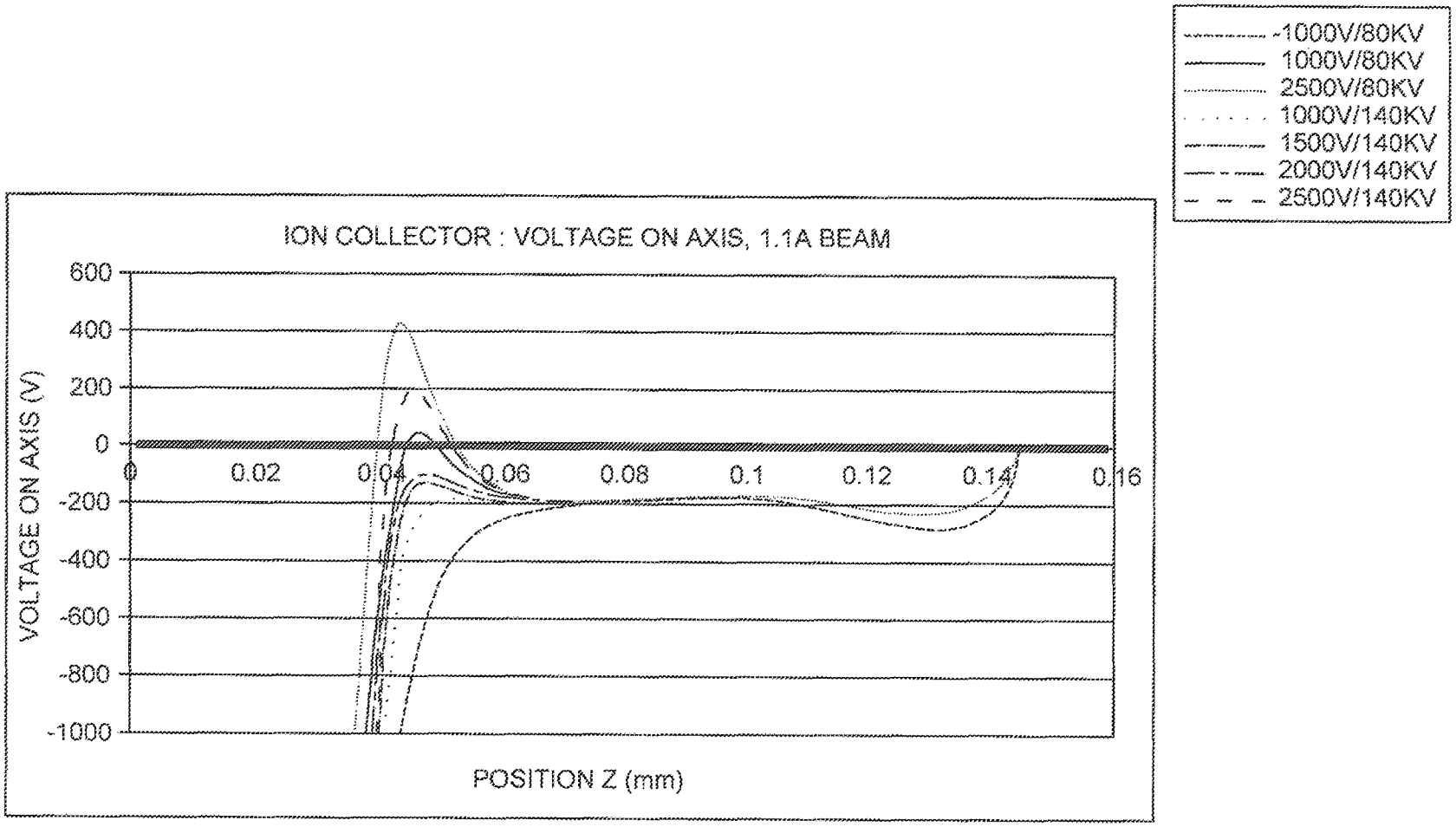
FIG. 7 is a graph of the barrier voltage achieved at the center of the electron beam path using different positive voltages applied to the ion barrier electrode versus cathode voltage.

In order to form and maintain the barrier 126 across the electrode 100, and in an exemplary, non-limiting embodiment of the invention, across and contained within the interior 101 of the electrode 100, the barrier electrode bias is adjusted such that the minimum positive potential of the barrier wall 126 is larger than ground potential, and is typically above 100-200V. This is because the typical kinetic energy of an ion 112 within the drift region 106 is less then 1 eV (thermal energies), the ions 112 that are generated by electron impact ionization in the drift region 106 of the electron beam 64 cannot move past the barrier potential wall 126. Stated differently, if the voltage $V_{gate}$ for the minimum barrier potential 126 at the center of the aperture 116 reaches 100V the ions 112 would need at least 100 times more than thermal energies to overcome the potential of the barrier 126. While it is sufficient to only raise the barrier potential slightly above the energy level of ions (e.g. 1V), it is generally advisable to provide a larger voltage (at least 10V-100V), to accommodate for geometric and electrical variability. As shown in FIG. 7, an ion barrier electrode 100 was operated at various voltages within a tube 12 being operated at either 80 kV or 140 kV. The various curves represent the barrier potential 126 at the center of the volume at various distances from the cathode assembly 60. For barrier electrodes 100 operated at 2500V for both 80 kV and 140 kV tube voltages, and at 2000V for a 140 kV tube voltage, the barrier electrode 100 produces a positive barrier potential 126. Further, the barrier potential 126 generated at 2500V exceeds the 100V-200V threshold for repulsion of the ions 112 by the electrode 100.

As described previously, the minimum positive bias required for the barrier 126 is dependent upon the geometry of the electrode 100 and the tube voltage. As shown on FIG. 7, tube voltages of 80 kV and 140 kV required bias voltages of 2500V to the barrier electrode 100, with a length of approximately eight (8) mm, to produce the desired barrier potential. With variations in the length of the ion barrier electrode 100, the voltage bias supplied to the electrode 100 can be varied to achieve the same minimum potential for the barrier 126.

Figure 8:
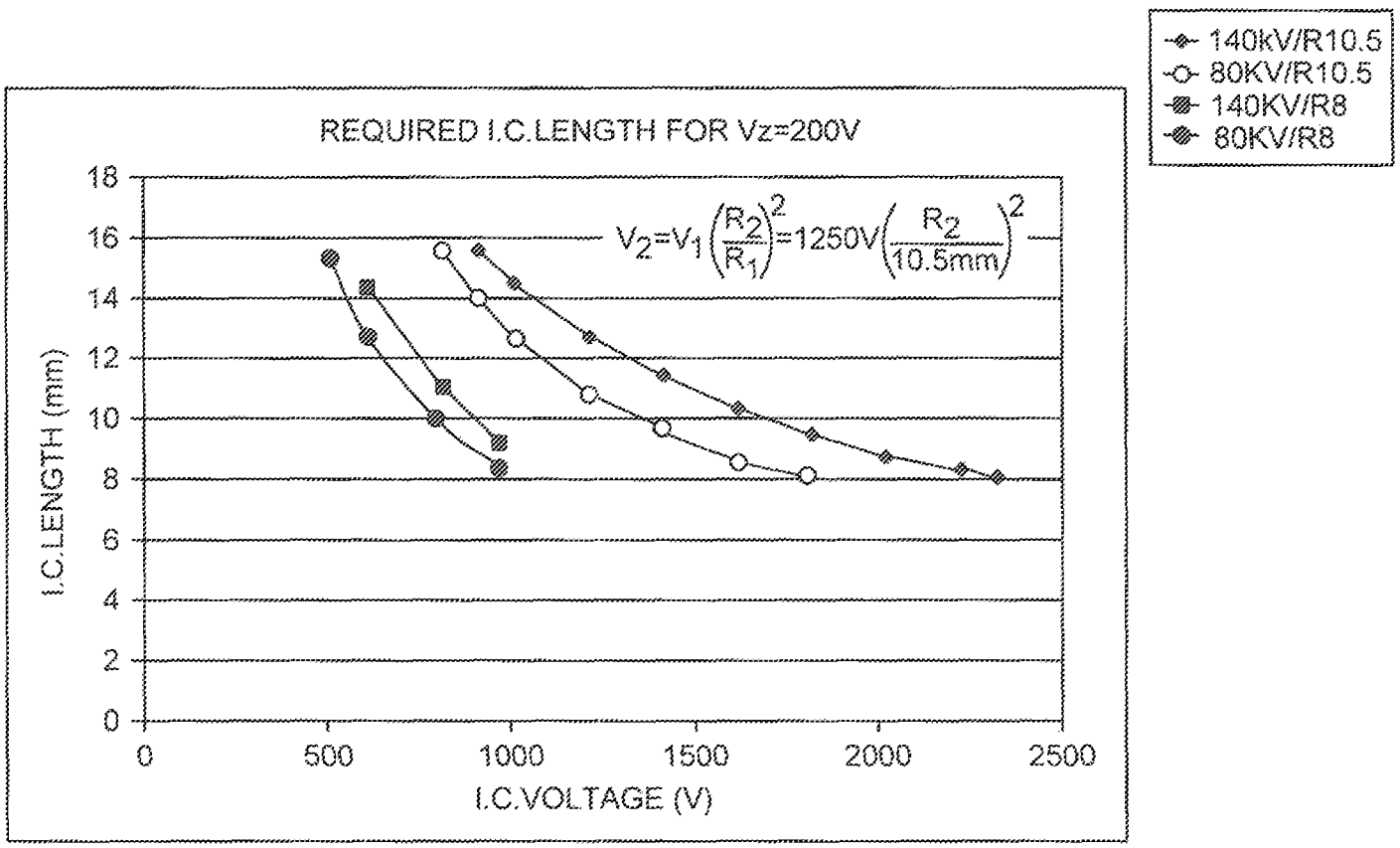
FIG. 8 is a graph of the length of the ion barrier cathode versus the voltage applied to the ion barrier electrode required to produce a potential barrier at the farthest distance from the barrier electrode (i.e. on the center of the electron beam path) of 200V for ion barrier electrodes of differing radii operated at different tube voltages.

Referring now to FIG. 8, plots of the bias voltage required to achieve a 200V barrier potential versus the length of the ion barrier electrode 100. The electrodes tested have radius of 10.5 mm or 8 mm and are operated at tube voltages of 80 kV or 140 kV. As illustrated, an increase in the length of the ion barrier electrode 100 reduces the bias voltage necessary to achieve the 200V potential for the barrier 126. Further, ion barrier electrodes 100 having smaller radii, but the same length also require less bias voltage to achieve the same 200V potential for the barrier 126. As a result, in an exemplary embodiment of the invention, the ion barrier electrode 100, whether formed with a circular or slit-type cross-section, is formed to have length between 5 mm-30 mm or in other exemplary embodiments from 8 mm-16 mm, and a radius of between 5 mm-20 mm, or in other exemplary embodiments from 6 mm-12 mm, in order to achieve the desired barrier potential (e.g., at least 10V-100V). Further, the interior surface 117 of the aperture 116 provides a space between the surface 117 and the electron beam 64, which in one exemplary embodiment is a space of 1 mm-5 mm between the ion barrier electrode surface 117 and the electron beam 64.

For electron beams 64 that are not cylindrically symmetric e.g., that are rectangular in shape or cross-section it is advantageous to shape the aperture 116 of the ion barrier electrode 100 according to the shape of the electron beam 64, e.g. to provide a rectangular shape. Similarly, it is advantageous in other exemplary embodiments that the cross-section of the aperture 116 increase or decrease along the direction of the electron beam 64 according to whether the electron beam 64 converges or diverges over the length of the barrier electrode 100. In one exemplary embodiment, depending upon the expansion or contraction (focusing) of the electron beam 64 in the area of the ion barrier electrode 100, the surface 117 can be formed to taper inwardly or outwardly to facilitate the focusing of the electron beam 64.

This range of sizes for the ion barrier electrode 100 allows the electrode 100 to be operated at bias voltages low enough to reduce the cost of the ion barrier high voltage feedthrough and power supply while providing good reliability of the electrode 100 and the tube 12.

In addition, by maintaining the positive ions in the drift region 106 of the tube 50 rather than extracting them towards the cathode assembly 60, the establishing of a charge balance between the positive ions 112 with the negative electron beam 64 is facilitated. This enables the beam 64 to maintain stability in focal spot performance for the tube 12. Furthermore, by maintaining the positive ions in the drift region 106 of the tube 50 rather than extracting them towards the cathode, any electrically biased areas in the cathode assembly 60 that are used to control the electron beam characteristics like shape or intensity, cannot be hit by these ions. Therefore, control electronics for cathode bias supplies does not have to account for such ion current load, which might vary greatly depending for example on tube pressure and electron beam intensity. Therefore, the electric control circuits can be simplified and a more stable tube operation is enabled.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An X-ray tube comprising:

a cathode configured to emit a beam of electrons;

an anode spaced from the cathode to define an acceleration area to accelerate the beam of electrons through an opening in the anode;

a target spaced from the anode and adapted to emit x-rays when struck by the beam of electrons;

an ion barrier electrode disposed between the cathode and the target and defining an aperture through which the beams of electrons can pass, wherein the ion barrier electrode is connectable to a voltage source so as to apply a voltage bias to the ion barrier electrode and generate a positively charged potential barrier across the ion barrier electrode or about a region including the ion barrier electrode or about a region including the ion barrier electrode and space extending beyond the perimetric boundaries of the ion barrier electrode, to deflect positively charged ions contacting the potential barrier.

2. The X-ray tube of claim 1 wherein the ion barrier electrode is disposed between the anode and the target.

3. The X-ray tube of claim 2 wherein the ion barrier electrode is disposed in close proximity to the anode.

4. The X-ray tube of claim 1 wherein the ion barrier electrode is shaped to minimize the required ion barrier supply voltage.

5. The X-ray tube of claim 4 wherein the ion barrier electrode has a radius of between 5 mm-20 mm.

6. The X-ray tube of claim 4 wherein the ion barrier electrode has a length of between 5 mm-30 mm.

7. The X-ray tube of claim 1 wherein the ion barrier electrode is ring-shaped.

8. The X-ray tube of claim 1 wherein the ion barrier electrode is generally rectangular in shape.

9. The X-ray tube of claim 8 wherein the aperture provides a space of between 1 mm-5 mm between the ion barrier electrode and the electron beam.

10. The X-ray tube of claim 8 wherein the aperture is tapered along the beam direction.

11. The X-ray tube of claim 10 wherein the aperture is inwardly tapered along the electron beam direction.

12. The X-ray tube of claim 1 wherein the potential barrier has positive potential of at least 10V-100V at a center of the aperture of the ion barrier electrode.

13. A method for minimizing damage to an emitter in an X-ray tube as a result of bombardment by positively charged ions within the X-ray tube to extend the useful life of the X-ray tube, the method comprising the step of:

providing an X-ray tube including an electrically insulating housing, a cathode disposed within the housing and configured to emit a beam of electrons, an anode disposed within the housing and spaced from the cathode, the anode including an opening through which the electron beam can pass, a target spaced from the anode within the housing and adapted to emit x-rays when struck by the beam of electrons, an ion barrier electrode disposed within the housing between the cathode and the target and defining an aperture through which the beams of electrons can pass and a voltage source connected to the ion barrier electrode to generate a positively charged potential barrier across the ion barrier electrode to repel positively charged ions contacting the potential barrier.

14. The method of claim 13, further comprising the steps of:

passing a current through the emitter to generate an electron beam that passes through the ion barrier electrode; and generating an exclusively positive potential barrier in the region of the ion barrier electrode that repels positively charged ions formed by the electron beam from passing through the ion barrier electrode.

15. The method of claim 14, wherein the step of generating the positive potential barrier comprises generating the barrier completely within an interior of the ion barrier electrode.

16. The method of claim 14, wherein the step of generating the positive potential barrier comprises generating a positive barrier of at least 10V-100V at a center of the aperture of the ion barrier electrode.

17. A method for stabilizing a focal spot for an electron beam in an X-ray tube, the method comprising the step of:

providing an X-ray tube including an electrically insulating housing, a cathode disposed within the housing and configured to emit a beam of electrons, an anode with an aperture to pass the electron beam, a target spaced from the anode within the housing and adapted to emit x-rays when struck by the beam of electrons, an ion barrier electrode disposed within the housing between the anode and the target and defining an aperture through which the beams of electrons can pass and a voltage source connected to the ion barrier electrode to generate a positively charged potential barrier across the ion barrier electrode to repel positively charged ions contacting the potential barrier.

18. The method of claim 17, further comprising the steps of:

passing a current through the emitter to generate an electron beam that passes through the ion barrier electrode; and generating a positive potential barrier on the ion barrier electrode that maintains positively charged ions in the drift region which create a charge balance with the negative electron beam.

19. The X-ray tube of claim 1, further comprising an electrically insulated housing, wherein at least one of the cathode, the anode, the target and the ion barrier electrode are disposed in the electrically insulated housing.

20. The X-ray tube of claim 19, wherein the cathode, the anode, the target and the ion barrier electrode are disposed in the electrically insulated housing.

* * * * *